US008607449B2

(12) United States Patent
Kitagawa et al.

(10) Patent No.: US 8,607,449 B2
(45) Date of Patent: Dec. 17, 2013

(54) METHOD OF WATERPROOFING CRIMPING PART

(75) Inventors: Hironori Kitagawa, Makinohara (JP); Yuichi Ito, Makinohara (JP); Naoki Ito, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/876,670

(22) Filed: Sep. 7, 2010

(65) Prior Publication Data

US 2011/0070781 A1 Mar. 24, 2011

(30) Foreign Application Priority Data

Sep. 24, 2009 (JP) ..... 2009-219559

(51) Int. Cl.
*H01R 43/048* (2006.01)
*H01R 43/033* (2006.01)
*H01R 4/18* (2006.01)

(52) U.S. Cl.
USPC ..... 29/863; 29/861; 29/857; 29/858; 174/110 R; 439/877; 439/884

(58) Field of Classification Search
USPC ..... 29/863, 861, 825, 827, 832, 852, 418, 29/957, 858; 439/877, 604, 883, 606, 521, 439/519, 522, 736, 884; 264/263, 275, 277, 264/259; 174/23 R, 78, 110 R
See application file for complete search history.

(56) References Cited

U.S. PATENT DOCUMENTS

| | | | | |
|---|---|---|---|---|
| 5,519,170 | A * | 5/1996 | Nabeshima | 174/74 R |
| 6,641,444 | B2 * | 11/2003 | Hanazaki et al. | 439/877 |
| 6,709,282 | B2 * | 3/2004 | Sugiyama | 439/275 |
| 7,572,979 | B2 * | 8/2009 | Otsuki et al. | 174/84 R |
| 8,147,281 | B2 * | 4/2012 | Kuwayama et al. | 439/877 |
| 2002/0009540 | A1 * | 1/2002 | Sasaki | 427/117 |
| 2002/0027013 | A1 * | 3/2002 | Kondo | 174/110 R |
| 2005/0095892 | A1 | 5/2005 | Fukuyama | |
| 2007/0209821 | A1 * | 9/2007 | Otsuki et al. | 174/88 R |

FOREIGN PATENT DOCUMENTS

| | | | |
|---|---|---|---|
| JP | 2001167821 | A | 6/2001 |
| JP | 2005135858 | A | 5/2005 |
| JP | 2005268194 | A | 9/2005 |
| JP | 2006286385 | A | 10/2006 |
| JP | 2009231080 | A * | 10/2009 |
| JP | 2010165630 | A | 7/2010 |
| JP | 2011029102 | A | 2/2011 |

OTHER PUBLICATIONS

Office Action issued Jul. 23, 2013, by the Japanese Patent Office in corresponding application No. 2009-219559.

* cited by examiner

*Primary Examiner* — Peter DungBa Vo
*Assistant Examiner* — Kaying Kue
(74) *Attorney, Agent, or Firm* — Sughrue Mion, PLLC

(57) ABSTRACT

A method of waterproofing a crimping part of a crimp terminal where a wire is crimped includes a step of forming a waterproof structure. The waterproofing structure seals a crimping region containing the crimping part with an adhesive tape. The adhesive tape has waterproofing performance and has a thickness no more than a predetermined value.

3 Claims, 10 Drawing Sheets

METHOD OF WATERPROOFING CRIMPING PART

BACKGROUND

The present invention relates to a method of waterproofing a crimping part between a crimp terminal formed of copper family material to be fitted by engagement to a connecter housing and a core wire part which is exposed in an end part of a coated aluminum wire.

End parts of electric wires including a wire harness which is arranged in a vehicle are so constructed, in many cases, as to be equipped with crimp terminals to be fitted by engagement to a connecter housing, for facilitating connection between the electric wires and an apparatus.

Conventionally, as the crimp terminal to be fitted by engagement to the connector housing, a crimp terminal formed of copper family material which is excellent in resiliency and electrical conductivity has been widely used.

On the other hand, in recent years, the number of the electric wires contained in the wire harness tends to be increased with an increase of electronic apparatuses mounted on the vehicle, and so, for the purpose of making the wire harness lightweight, use of a coated aluminum wire of a type that a core wire formed of aluminum or aluminum alloy is covered with an insulating sheath has been required.

Under such circumstances, it is necessary to secure reliability of such a structure that the crimp terminal formed of copper family material is connected by crimping to the end part of the coated aluminum wire.

However, because metals of different kinds are contacted with each other in a crimping part where the crimp terminal formed of copper family material is connected by crimping to the end part of the coated aluminum wire, erosion is likely to occur when water adheres to the crimping part. Consequently, there is such anxiety that inconveniences such as faulty connection may be incurred by the erosion in the crimping part.

Therefore, the crimping part between the coated aluminum wire and the crimp terminal formed of copper family material must be designed as a waterproofing structure for preventing adhesion of water.

Heretofore, as the method of waterproofing the crimping part by designing the crimping part as the waterproofing structure, there has been proposed the art in which the crimping part is tight-sealed with a resin mold (see, Patent Document 1) or the art in which a heat contractive tube covered around the crimping part is contracted thereby to tight-seal the crimping part (see, Patent Document 2).

[Patent Document 1] Japanese Patent Publication Number 2001-167821 A

[Patent Document 2] Japanese Patent Publication Number 2005-268194 A

However, in case of the waterproofing methods which are disclosed in the above described Patent Documents, an outer shape of the crimping part is swelled outward by 0.1 mm or more from the outer shape of the crimp terminal, in both cases. Consequently, it becomes unable to fit the crimp terminal by engagement to the connector housing of which a clearance with respect to the crimp terminal is set to be 0.1 mm or less.

In short, in case of the crimp terminal formed of copper family material to be fitted by engagement to the connector housing, it is impossible to apply the conventional waterproofing structure to the crimping part. Moreover, because waterproofing performance of the crimping part cannot be secured, there has been such a problem that it is impossible to enhance erosion resistance of the crimping part.

SUMMARY

It is therefore one advantageous aspect of the present invention to provide a method of waterproofing a crimping part in which erosion resistance of the crimping part between a coated aluminum wire and a crimp terminal formed of copper family material can be enhanced, by securing favorable waterproofing performance of the crimping part, and at the same time, fitting ability of the crimp terminal to the connector housing is not damaged.

According to one aspect of the invention, there is provided a method of waterproofing a crimping part of a crimp terminal where a wire is crimped, the method comprising:

a step of forming a waterproofing structure sealing a crimping region containing the crimping part with an adhesive tape, the adhesive tape having waterproofing performance and having a thickness no more than a predetermined value.

The step of forming may include: a step of crimping a core wire of the wire which is exposed at an end portion of the wire to the crimp terminal; a step of covering the crimping region with the adhesive tape after the step of crimping, the crimping region including a distal end portion of the core wire projecting on a neck part of the crimp terminal and an end of a crimped sheath of the wire opposite to the distal end portion; and a step of pressing a part of the adhesive tape covering the crimping region to an opposing face of the neck part so as to close an opening defined by the part of the adhesive tape and the neck part.

The step of pressing may include: a step of squeezing the part of the adhesive tape pressed to the neck part in an axial direction of the wire.

The step of pressing may be performed under heating condition so that the adhesive tape exerts ductibility.

The step of forming may include: a step of covering an end face and a circumferential face of a distal end portion of a core wire of the wire with the adhesive tape, the distal end portion projecting on a neck part of the crimp terminal; a step of crimping the core wire to the crimp terminal after the step of covering, the core wire being exposed at an end portion of the wire; and a step of covering the crimping region with the adhesive tape after the crimping.

The step of covering of the end face and the circumferential face may be performed under heating condition so that the adhesive tape exerts ductibility.

The predetermined value may be 0.05 mm.

A material of the crimp terminal and a material of the core wire are different each other.

The material of the crimp terminal may be cooper family material, and the material of the core wire may be aluminum.

According to another aspect of the invention, there is provided a waterproofing structure of a crimping part, the waterproofing structure comprising:

a wire;

a crimp terminal having a crimping region where the wire is crimped; and an adhesive tape covering the crimping region so as to perform tight-sealing, the adhesive tape having waterproofing performance and having a thickness no more than a predetermined value.

DETAILED DESCRIPTION OF EXEMPLIFIED EMBODIMENTS

Figure 1A:
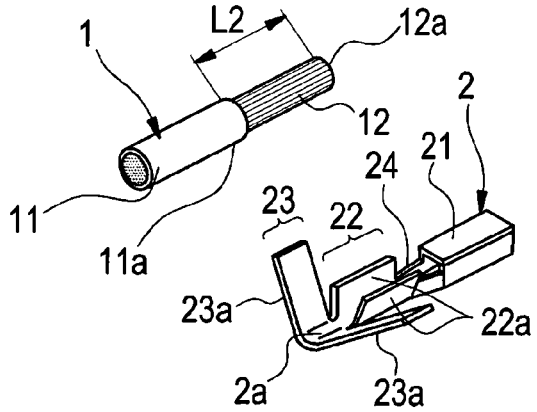
FIG. 1A is an explanatory view showing a state before a coated aluminum wire having a sheath on an end part thereof removed is placed on a crimp terminal formed of copper family material, in a first embodiment according to the present invention.

A method of waterproofing a crimping part in embodiments according to the invention will be described in detail, referring to the drawings.

FIGS. 1 to 5 show the method of waterproofing the crimping part in a first embodiment according to the invention.

Figure 1B:
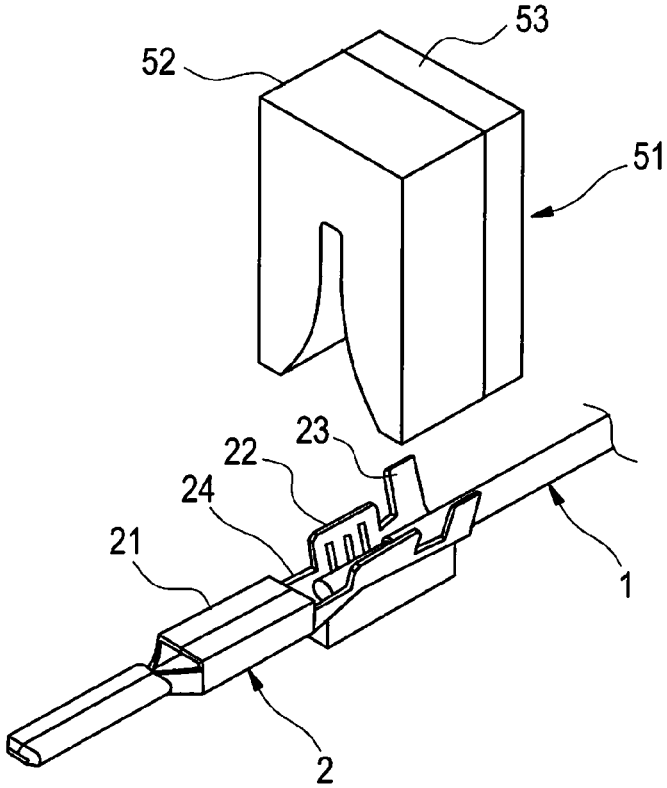
FIG. 1B is an explanatory view showing a step for crimping the coated aluminum wire to the crimp terminal by an exclusive crimping machine, in the first embodiment.
Figure 1C:
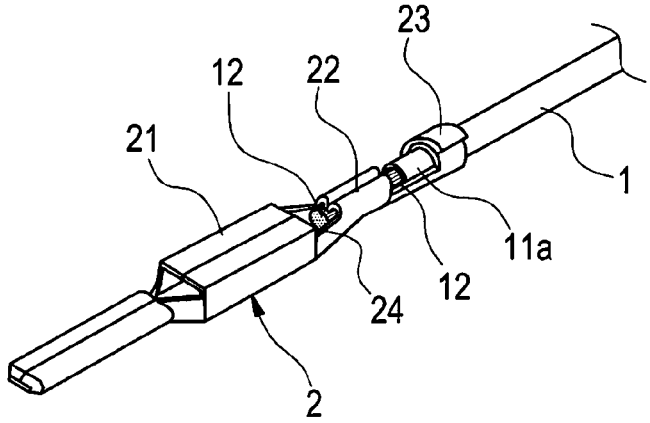
FIG. 1C is a perspective view showing a state where the coated aluminum wire has been connected by crimping to the crimp terminal, in the first embodiment.

The method of waterproofing the crimping part in this first embodiment is a method of applying waterproofing performance to a crimping part between a coated wire 1 and a crimp terminal 2 as shown in FIGS. 1A to 1C. In this embodiment, a material of a core wire part 12 of the coated wire 1 is aluminum, and a material of the crimp terminal 2 is copper family material. The present invention can be applied to such a configuration that the material of the core wire part 12 and the material of the crimp terminal 2 are different each other.

Before the coated aluminum wire 1 is connected to the crimp terminal 2 formed of copper family material, the coated aluminum wire 1 is subjected to an end treatment for removing a sheath 11 on an end part thereof, and the core wire part 12 to be crimped having a determined length is exposed in the end part.

The crimp terminal 2 is fitted by engagement to a connector housing which is not shown.

The crimp terminal 2 is an article stamped from a metal plate, and includes, as shown in FIGS. 1A to 1C, a terminal engaging part 21 to be engaged with a mating connecting terminal, a core wire caulking part 22 for crimping the core wire part 12 to be crimped of the coated aluminum wire 1, and a coated part caulking part 23 for fixing a coated part 11*a* which is adjacent to the core wire part 12 to be crimped of the coated aluminum wire 1.

As shown in FIG. 1A, the core wire caulking part 22 includes a pair of caulking pieces 22*a*, 22*a* extended to both sides of a terminal bottom plate 2*a* which is extended from the terminal engaging part 21.

The coated part caulking part 23 includes a pair of caulking pieces 23*a*, 23*a* which are extended to both sides of the terminal bottom plate 2*a*, as shown in FIG. 1A.

As shown in FIGS. 1A to 2B, the crimp terminal 2 is provided with a terminal neck part 24 between the terminal engaging part 21 and the core wire caulking part 22. The terminal neck part 24 has a length L1 in an axial direction of the terminal, as shown in FIG. 2A.

On occasion of applying the end treatment to the coated aluminum wire 1, a length L2 (See FIG. 1A) of the core wire part 12 to be crimped is generally set to be longer than a length L3 (See FIG. 2A) of the core wire caulking part 22 in the axial direction of the terminal.

Figure 2A:
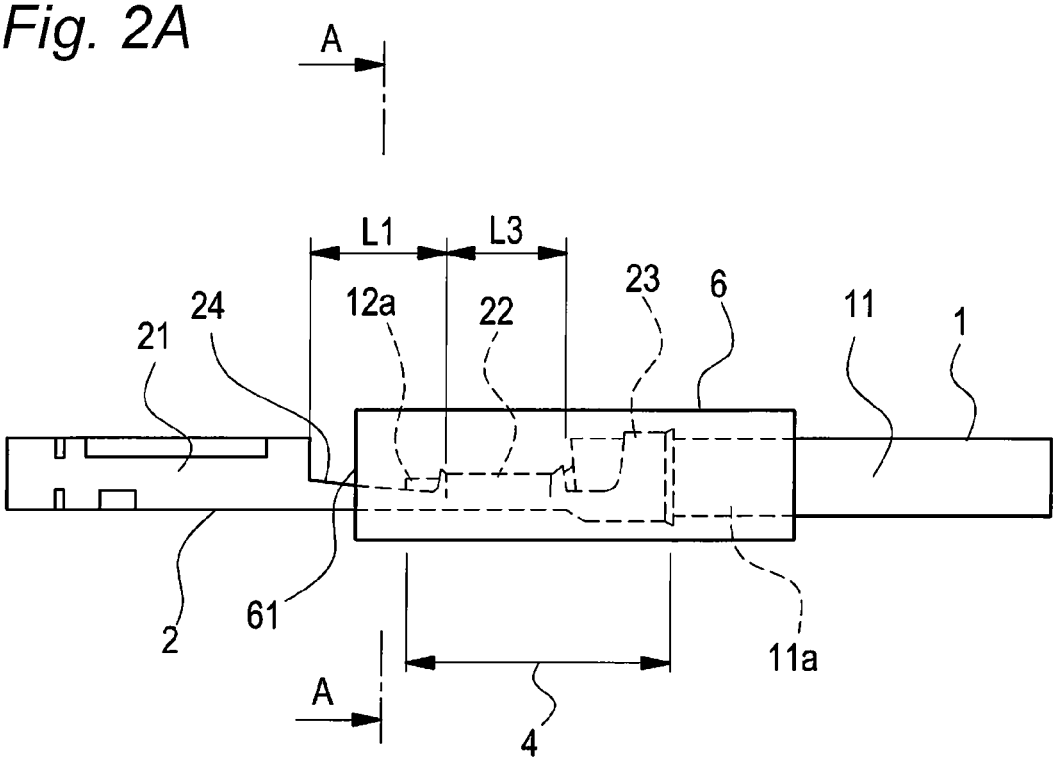
FIG. 2A is a side view showing a state where a crimping part is covered with an adhesive tape in a crimping part tape covering step of the first embodiment.

Therefore, in a state where the core wire part 12 to be crimped of the coated aluminum wire 1 is crimped to the core wire caulking part 22, a distal end 12*a* of the core wire part 12 to be crimped protrudes from the core wire caulking part 22 toward the terminal engaging part 21 to be positioned at a middle of the terminal neck part 24, as shown in FIG. 2A.

This method of waterproofing the crimping part in the first embodiment is to form a waterproofing structure in which a range containing a crimping region 4 between the coated aluminum wire 1 and the crimp terminal 2 is tight-sealed with an adhesive tape 6 (See FIG. 2A) having a thickness below a prescribed value.

Herein, the crimping region 4 is a region extending from the distal end 12*a* of the core wire part 12 to be crimped to a back end of the coated part caulking part 23, and containing a crimping part formed by the core wire caulking part 22, as shown in FIG. 2A.

The prescribed value of the thickness of the adhesive tape 6 is so set that a swell due to the thickness of the tape which is wound around the crimp terminal 2 may not damage fitting ability of the crimp terminal to the connector housing.

A clearance between a terminal containing part of the connector housing and the crimp terminal 2 is set to be about 0.1 mm, in case of a small connector housing.

Therefore, in this embodiment, the thickness of the adhesive tape 6 to be used is set to be 0.05 mm.

Describing further in detail, the adhesive tape 6 is obtained by forming an adhesive layer on one face of a substrate in a form of a transparent film having waterproofing performance, and the adhesive tape 6 having the thickness of 0.05 mm or less including the substrate and the adhesive layer is used.

Then, steps for forming the waterproofing structure in which the crimping region 4 is tight-sealed with the transparent adhesive tape 6 in this embodiment will be described in series, referring to FIGS. 1A to 5D.

As a first step, as shown in FIG. 1A, the coated aluminum wire 1 having the core wire part 12 to be crimped exposed in the end part thereof, and the crimp terminal 2 are prepared in advance.

Then, as shown in FIG. 1B, the end part of the coated aluminum wire 1 is positioned on the crimp terminal 2, and a wire crimping step for connecting by crimping the core wire part 12 to be crimped to the crimp terminal 2 is conducted, using an exclusive crimping machine 51.

The crimping machine 51 includes a first crimping part 52 for caulking the core wire caulking part 22 onto the core wire part 12 to be crimped, and a second crimping part 53 for caulking the coated part caulking part 23 onto the coated part 11*a*.

When the wire crimping step has been finished, the core wire part 12 to be crimped in the end part of the coated aluminum wire 1 is brought into a state electrically connected to the crimp terminal 2 by way of the core wire caulking part 22, as shown in FIG. 1C. Moreover, as shown in FIG. 1C, the coated part 11*a* adjacent to the core wire part 12 to be crimped is brought into a state fixed to the crimp terminal 2 by way of the coated part caulking part 23.

After the wire crimping step has been finished, a crimping part tape covering step is conducted.

Figure 2B:
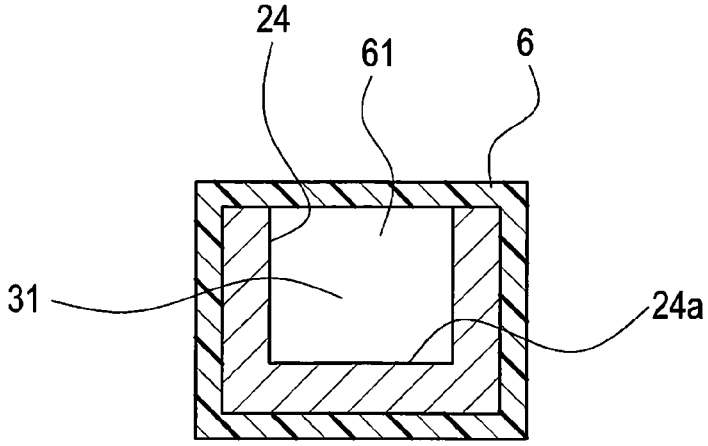
FIG. 2B is a sectional view taken along a line A-A in FIG. 2A.

This crimping part tape covering step is a step for covering the range containing the aforesaid crimping region 4, as shown in FIGS. 2A and 2B.

The adhesive tape 6 is formed into a tubular shape covering a circumference of the crimp terminal 2, by winding, for example, an adhesive tape having a lateral length (or a longitudinal length) longer than a length of the crimping region 4, around the crimp terminal 2.

Because the adhesive tape 6 which is wound around outer peripheries of the coated part caulking part 23 of the crimp terminal 2 and the coated part 11*a* is formed in a cylindrical structure, a tight-sealed state where the tape is in favorable tight contact with mating faces can be obtained, only by firmly pressing the adhesive tape 6 with fingers or the like.

However, as shown in FIG. 2B, the adhesive tape 6 which is wound around an outer face of the terminal neck part 24 of the crimp terminal 2 is formed in an angled tubular shape having an opening 61 at a side of the terminal engaging part 21. Moreover, as also shown in FIG. 2B, a space 31 in a rectangular shape is defined between an inner wall face 24*a* of the terminal neck part 24 and the adhesive tape 6 covering an opening of the terminal neck part 24.

In this state, after the crimping part tape covering step has been finished, a tape pressing step as shown in FIGS. 3 to 5D is conducted.

Figure 3:
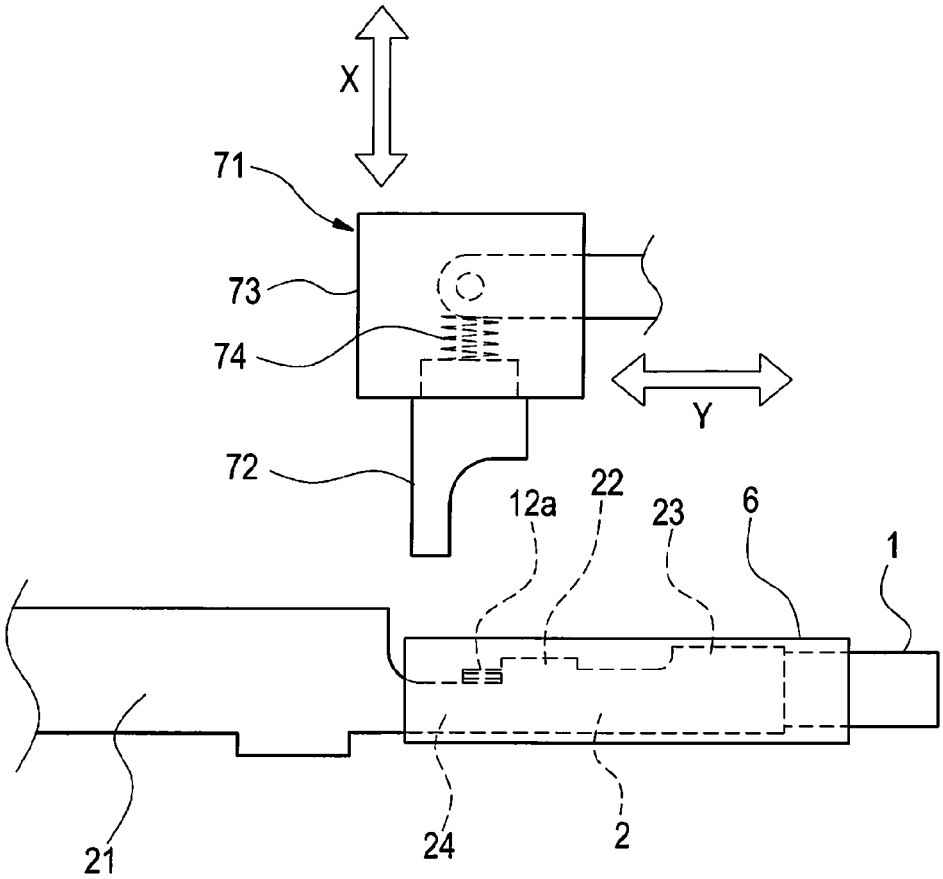
FIG. 3 is a view for explaining a structure of a pressing jig which is used in a tape pressing step in the method of waterproofing the crimping part in the first embodiment.

In the tape pressing step, a pressing jig 71 as shown in FIG. 3 is used.

The pressing jig 71 includes a pressing metal tip 72 which is inserted into the opening of the terminal neck part 24 to collapse the opening 61 of the adhesive tape 6, and a jig body 73 for holding this pressing metal tip 72.

Moreover, although not shown, the pressing jig 71 is provided with a terminal mounting table for supporting the crimp terminal 2 having the coated aluminum wire 1 crimped thereto, in such a manner that the opening of the terminal neck part 24 is directed to the pressing metal tip 72.

The jig body 73 holds the pressing metal tip 72 by way of a resilient member 74 for adjusting pressure of the pressing metal tip 72.

The jig body 73 can be moved up and down with respect to the crimp terminal 2 which is mounted on the terminal mounting table, by a lift mechanism which is not shown. An arrow mark X in FIG. 3 shows a direction in which the jig body 73 can move up and down.

Moreover, the jig body 73 can slide (horizontally move) in a direction of an arrow mark Y in FIG. 3, by a slide driving mechanism which is not shown.

The direction of the arrow mark Y in FIG. 3 is an axial direction of the crimp terminal 2 which is held on the terminal mounting table.

The movement of the jig body 73 in the direction of the arrow mark Y in FIG. 3 is used for an action of squeezing the adhesive tape 6 which is being pressed.

Figure 4A:
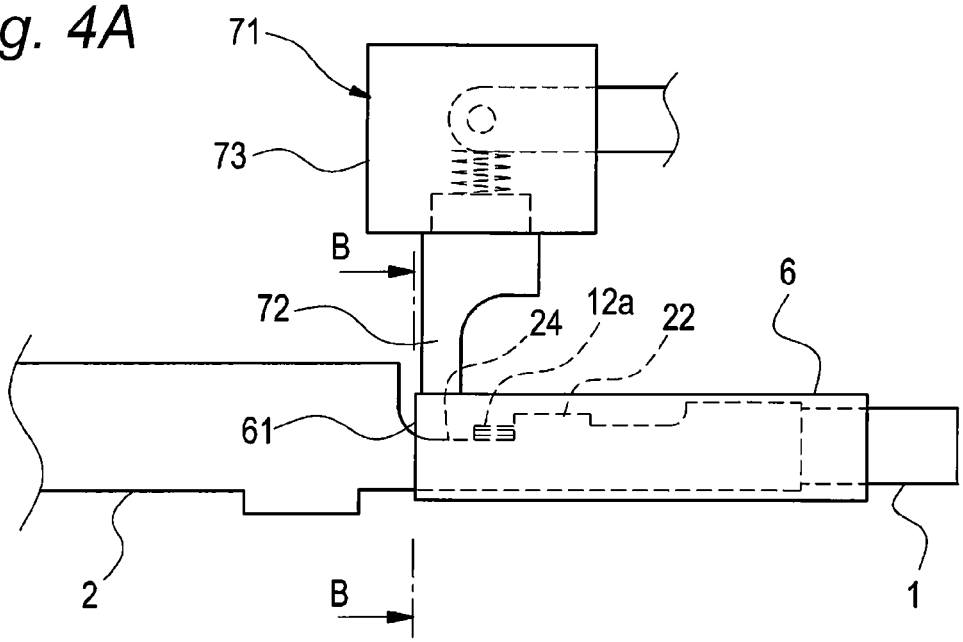
FIG. 4A is a side view showing a state where an exclusive pressing jig started to be contacted with an opening of the adhesive tape, in the first embodiment.
Figure 4B:
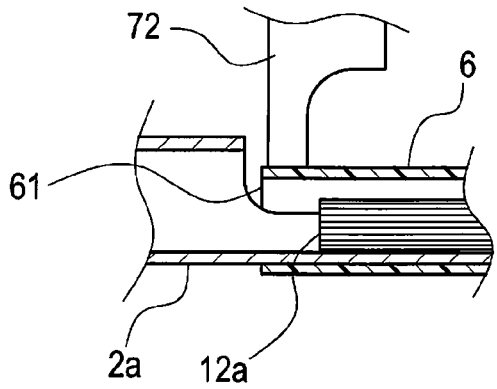
FIG. 4B is a side view schematically showing relation between the pressing jig in FIG. 4A and the adhesive tape.
Figure 4C:
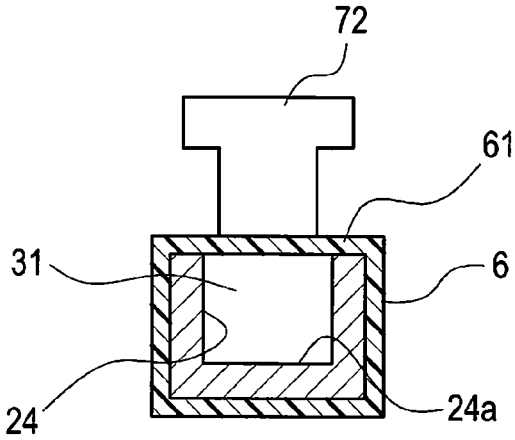
FIG. 4C is a sectional view taken along a line B-B in FIG. 4A.

In the tape pressing step as shown in FIGS. 3 to 5D, as a first step, the jig body 73 is moved down toward the terminal neck part 24 of the crimp terminal 2 which is positioned on the terminal mounting table, which is not shown, thereby to bring the pressing metal tip 72 into contact with an upper end of the opening 61 of the adhesive tape 6, as shown in FIG. 4C.

Figure 5A:
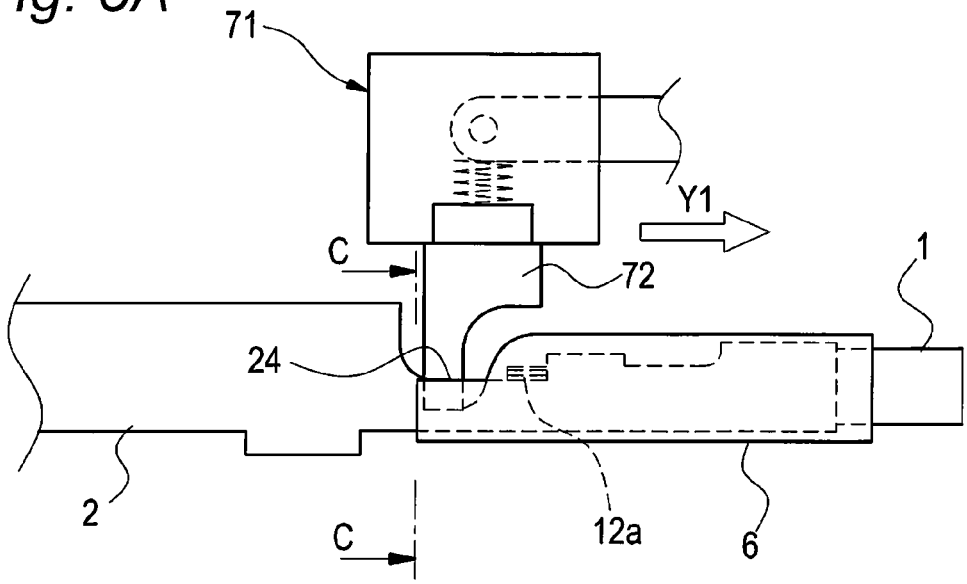
FIG. 5A is a side view of the crimp terminal in a state where an opening end of the adhesive tape covering the crimping part is pressed and collapsed by the exclusive pressing jig, in the first embodiment.
Figure 5B:
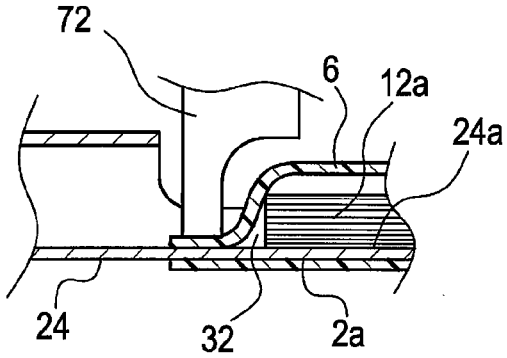
FIG. 5B is a side view schematically showing relation between the pressing jig in FIG. 5A and the adhesive tape.
Figure 5C:
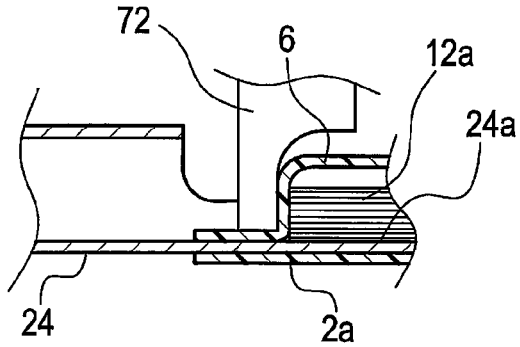
FIG. 5C is a side view schematically showing a state where the pressing jig which is pressing the adhesive tape is slid to squeeze the pressed part.
Figure 5D:
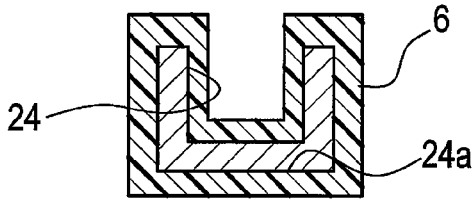
FIG. 5D is a sectional view taken along a line C-C in FIG. 5A.

Then, the jig body 73 is further moved down, and, as shown in FIGS. 5A to 5D, the upper part of the opening 61 of the adhesive tape 6 is pressed against the inner wall face 24*a* of the terminal neck part 24 (See FIG. 5B). In this manner, the tight-sealed state where the space 31 between the terminal neck part 24 and the adhesive tape 6 is eliminated can be obtained, as shown in FIG. 5D.

In the tape pressing step in this embodiment, the pressing metal tip 72 is slid in a direction of an arrow mark Y1 in FIG. 5A, in a state where the adhesive tape 6 covering the terminal is pressed against a surface of the terminal with the pressing metal tip 72. The adhesive tape 6 which is pressed against the surface of the terminal is squeezed by this sliding motion of the pressing metal tip 72, thereby to attach the adhesive tape 6 to the surface of the terminal in a tight-sealed manner.

By squeezing the adhesive tape 6 with the sliding motion of the pressing metal tip 72, it is possible to eliminate a gap 32 (See FIG. 5B) which remains in front of the distal end 12*a* of the core wire part 12 to be crimped.

After the tape pressing step has been finished, it would be preferable that the tape pressing part is heated up by heating means (a hot air heater, a high temperature room, etc.) which are separately prepared, thereby to enhance an attaching force between the adhesive tape 6 and the surface of the terminal to bring them into tight contact.

Instead of separately preparing the heating means, the jig body 73 may be provided with a heater for raising temperature of the pressing metal tip 72 to a determined temperature. This heater controls a temperature rise of the pressing metal tip 72 so that the adhesive tape may be heated with the temperature rise of the pressing metal tip 72 so as to exert appropriate ductibility.

In this case, in the tape pressing step in this embodiment, the adhesive tape 6 is pressed in a state where the temperature of the pressing metal tip 72 has been raised to the determined temperature by the heater which is incorporated therein. In this manner, the pressing metal tip 72 presses the adhesive tape 6 against the mating face under the heating condition where the adhesive tape 6 can exert appropriate ductibility, and brings the adhesive tape 6 into tight contact with the mating face.

When the tape pressing step as described above has been finished, the adhesive tape 6 covering the crimping region 4 of the crimp terminal 2 is formed into the waterproofing structure in which the crimping region 4 is tight-sealed.

According to the method of waterproofing the crimping part in the first embodiment which has been heretofore described, the crimping part between the coated aluminum wire 1 and the crimp terminal 2 formed of copper family material is tight-sealed in the waterproofing structure with the adhesive tape 6 having the waterproofing performance. As the results, it is possible to secure favorable waterproofing performance in the crimping part thereby to enhance erosion resistance of the crimping part.

In addition, because the adhesive tape 6 having the thickness of 0.05 mm or less is used as the adhesive tape 6 having the waterproofing performance, the swell of the waterproofing structure due to the adhesive tape 6 which tight-seals the crimping part can be depressed to 0.1 mm or less.

Accordingly, even in case where the clearance between the crimp terminal 2 and the terminal containing part of the connector housing to be engaged with the crimp terminal 2 is less than 0.1 mm, fitting ability of the crimp terminal 2 to the connector housing will not be damaged by the waterproofing structure.

Moreover, according to the method of waterproofing the crimping part in the above described embodiment, by conducting the crimping part tape covering step as shown in FIGS. 2A and 2B and the tape pressing step as shown in FIGS. 3 to 5D, it is possible to obtain the waterproofing structure formed of the adhesive tape 6 in which the circumference of the crimping part is tight-sealed and the swell outward of the crimping part is depressed to 0.1 mm or less. Therefore, it is possible to enhance erosion resistance of the crimping part, without damaging fitting ability to the connector housing, as described above.

Moreover, according to the method of waterproofing the crimping part in the above described embodiment, operation for squeezing the adhesive tape 6 which has been pressed against the surface of the terminal is conducted in the tape pressing step, as shown in FIGS. 5A to 5D.

As the results, the attaching force of the adhesive tape 6 with respect to the surface of the terminal is enhanced, and sealing performance by the adhesive tape 6 can be further enhanced.

Moreover, according to the method of waterproofing the crimping part in the above described embodiment, the adhesive tape 6 is pressed against the mating face in a state where the adhesive tape 6 has been made easily extendable, by being heated by the pressing metal tip 72 whose temperature has been raised, and brought into tight contact with the mating face. Therefore, the adhesive tape 6 can be firmly attached to the surface of the crimp terminal 2 according to undulations of the crimp terminal 2, and the sealing performance with the adhesive tape 6 can be further enhanced.

Moreover, according to the method of waterproofing the crimping part in the above described embodiment, the transparent adhesive tape 6 is used, and hence, it is possible to visually see condition of the crimping part through the adhesive tape 6.

Therefore, occurrence of rust in the crimping part can be visually detected at an early time, and it is possible to cope with the case where the rust has occurred in the crimping part at an early time.

FIGS. 6A to 9 show the method of waterproofing the crimping part in a second embodiment according to the invention.

In this method of waterproofing the crimping part in the second embodiment, the crimping region 4 containing the crimping part between the coated aluminum wire 1 and the crimp terminal 2 formed of copper family material as shown in FIG. 1A is tight-sealed with waterproofing adhesive tapes 6A and 6B having a thickness below a prescribed value (less than 0.05 mm) thereby to form a waterproofing structure.

Then, steps for forming the waterproofing structure in which the crimping region 4 is tight-sealed with the transparent adhesive tapes 6A and 6B in this embodiment will be described in series, referring to FIGS. 6A to 9.

It is to be noted that definitions of the coated aluminum wire 1, the crimp terminal 2, and the crimping region 4 are the same as those in the first embodiment, and description of them will be omitted here.

The adhesive tapes 6A and 6B to be used in this embodiment may be the same as the adhesive tape 6 which is shown in the first embodiment.

In this method of waterproofing the crimping part in the second embodiment, a core wire end covering step as shown in FIGS. 6A to 7B is conducted, before the core wire part 12 to be crimped which is exposed in the end part of the coated aluminum wire 1 is crimped to the core wire caulking part 22 of the crimp terminal 2.

Figure 6A:
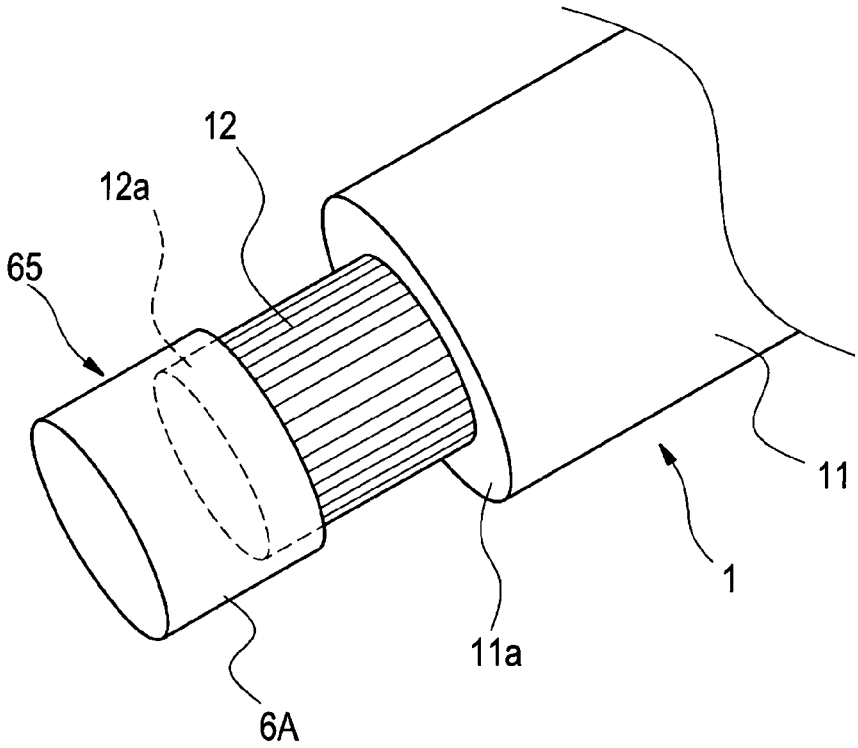
FIG. 6A is a perspective view showing a state where an adhesive tape is wound around a distal end portion of a core wire part to be crimped, in a second embodiment according t the preset invention.
Figure 6B:
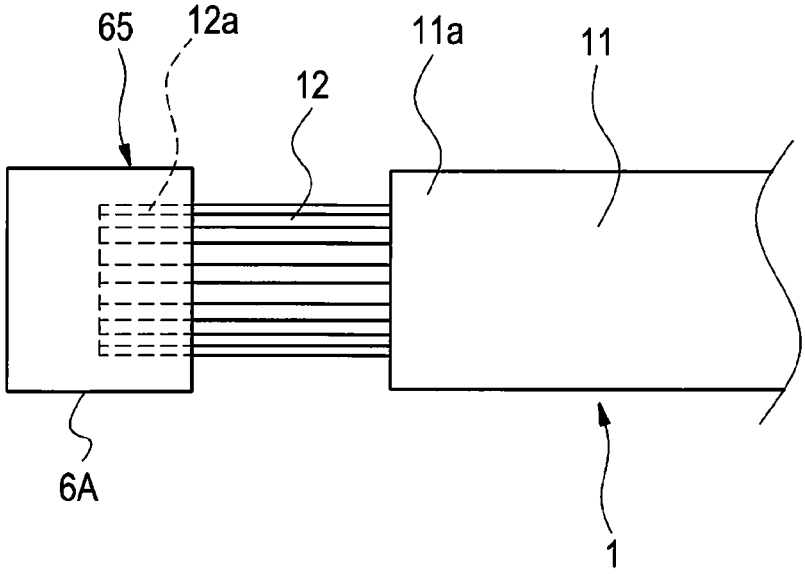
FIG. 6B is a side view showing the state in FIG. 6A.

In the core wire end covering step, as a first step, as shown in FIGS. 6A and 6B, the adhesive tape 6A is wound around the distal end 12*a* of the core wire part 12 to be crimped which is protruded from the core wire caulking part 22 to the terminal neck part 24, when the core wire part is crimped to the crimp terminal 2. On this occasion, a cylindrical part 65 is formed by the adhesive tape 6A which is wound, and a length of the cylindrical part 65 is set to be such a length as extending forward of the distal end 12A.

Figure 7A:
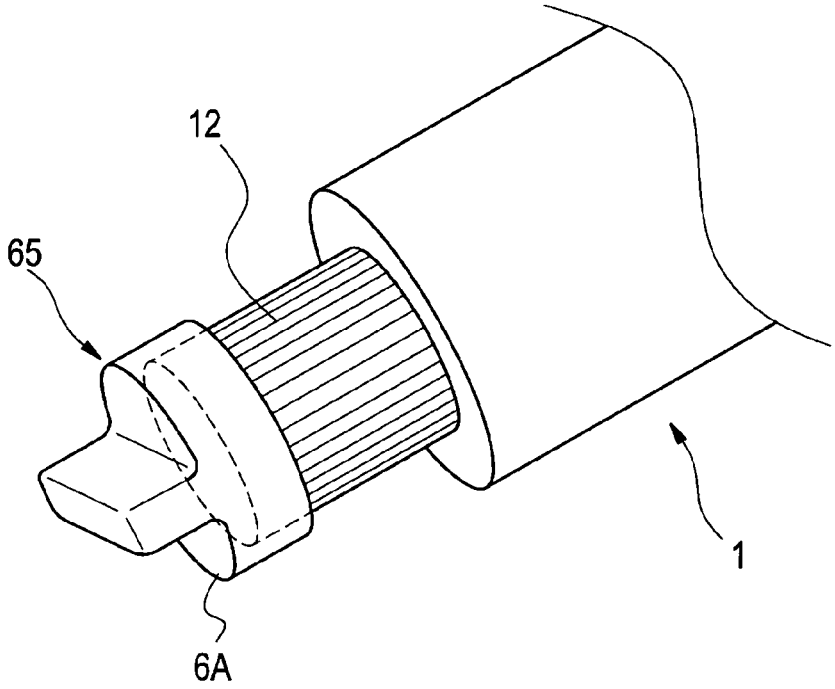
FIG. 7A is a perspective view showing a state where a distal end of the adhesive tape which is wound around the distal end portion of the core wire part to be crimped is collapsed and formed into such a shape that a distal end face of the core wire part to be crimped is covered with the adhesive tape, in the second embodiment.
Figure 7B:
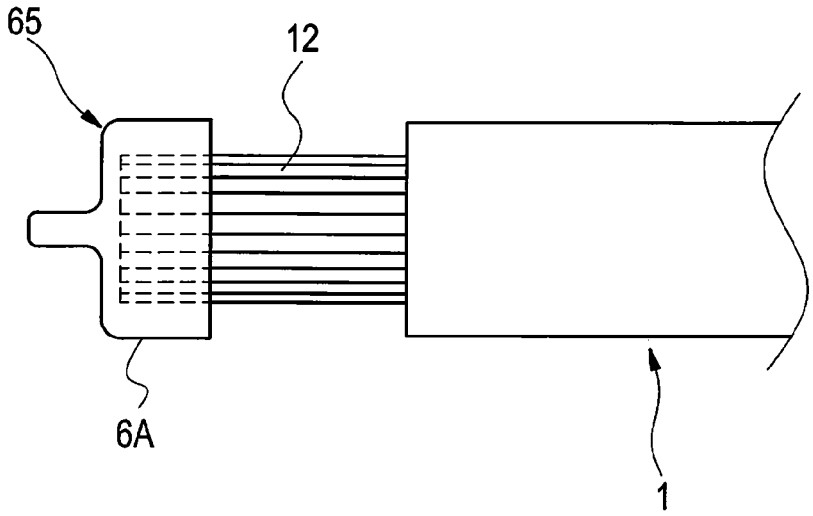
FIG. 7B is a side view showing the state in FIG. 7A.

Then, as shown in FIGS. 7A and 7B, a distal end portion of the cylindrical part 65 extending from the distal end 12A of the core wire part 12 to be crimped is pressed and collapsed into a state where the distal end 12*a* is covered with the adhesive tape 6A.

Specifically, this core wire end covering step in this embodiment is a step for covering an end face and an outer face of the distal end 12*a* of the core wire part 12 to be crimped which is protruded from the core wire caulking part 22 to the terminal neck part 24, when the core wire part is crimped to the crimp terminal 2, with the adhesive tape 6A.

The coated aluminum wire after the core wire end covering step has been finished is called as a coated aluminum wire 1A, for the purpose of discriminating it from the coated aluminum wire 1 before the core wire end covering step is conducted.

Figure 8A:
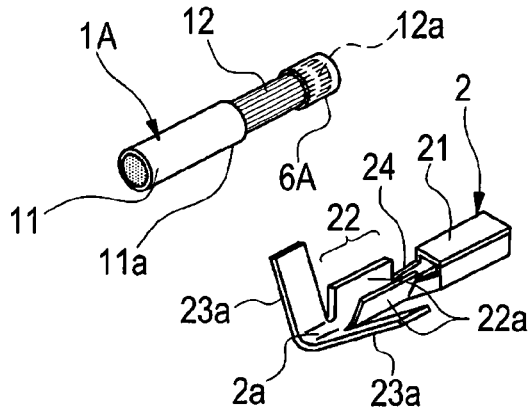
FIG. 8A is a perspective view showing a state where the coated aluminum wire after the core wire end covering step has been finished is placed on the crimp terminal, in the second embodiment.
Figure 8B:
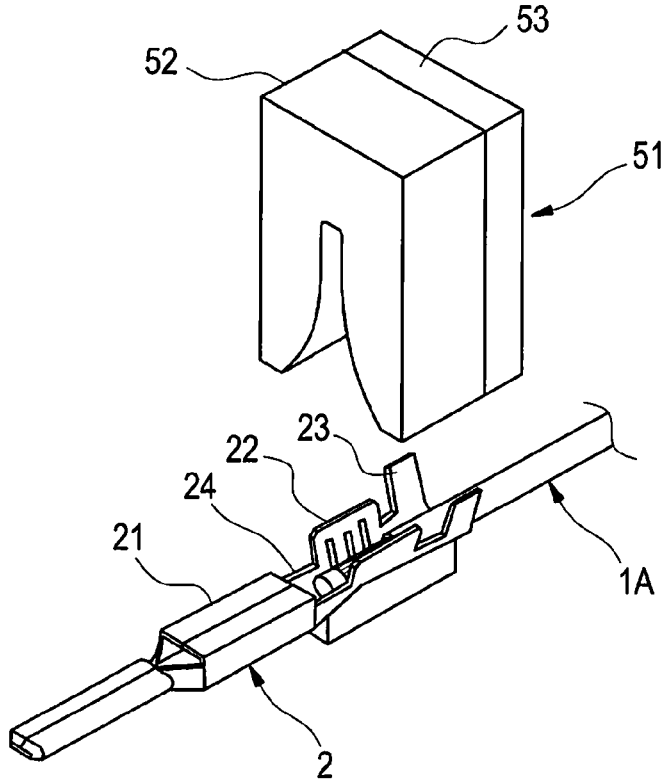
FIG. 8B is a perspective view showing the wire crimping step in the second embodiment.
Figure 8C:
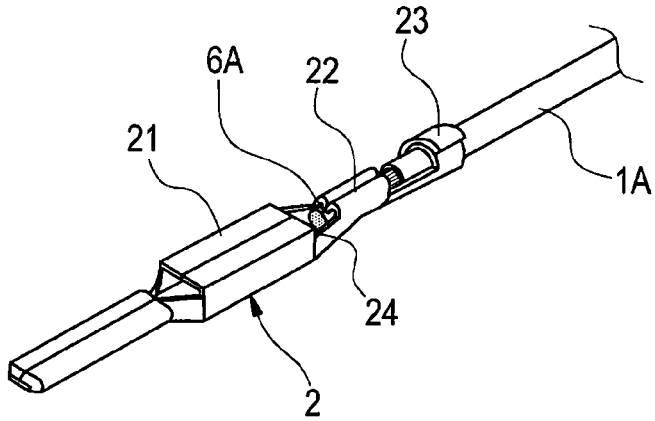
FIG. 8C is a perspective view showing a state where an end part of the coated aluminum wire has been crimped to the crimp terminal, in the second embodiment.

Then, as shown in FIGS. 8A to 8C, a wire crimping step for crimping the coated aluminum wire 1A, after the core wire end covering step has been finished, to the crimp terminal 2 is conducted. A crimping machine 51 to be used in this wire crimping step is the same as the crimping machine which is used in the wire crimping step in the first embodiment.

After the wire crimping step has been finished, a crimping part tape covering step is conducted.

Figure 9:
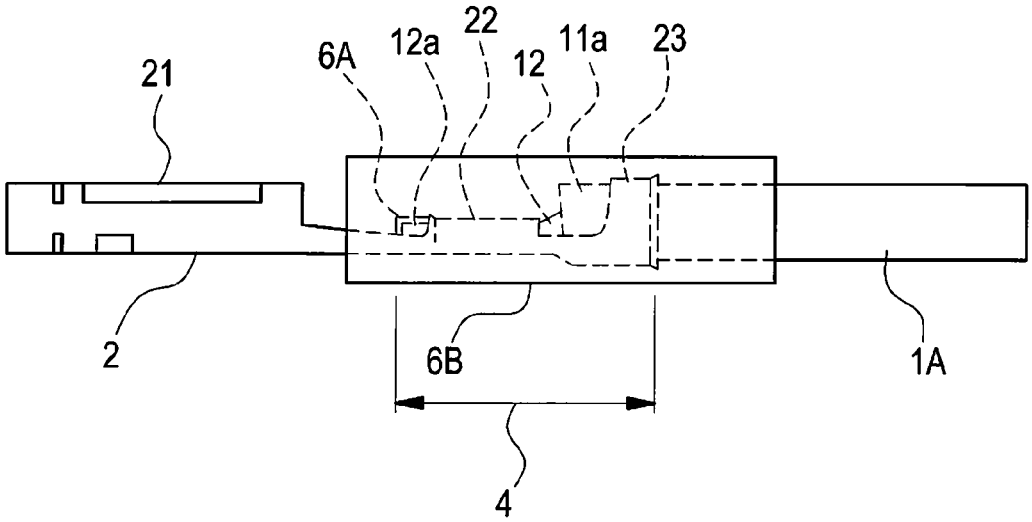
FIG. 9 is a side view showing a state where the crimping part is covered with the adhesive tape in the crimping part tape covering step in the method of waterproofing the crimping part in the second embodiment.

The crimping part tape covering step is a step for covering the range containing the crimping region 4 which extends from the distal end 12*a* of the core wire part 12 to be crimped to a back end of the coated part caulking part 23 on the crimp terminal 2, with the transparent adhesive tape 6B, as shown in FIG. 9.

The adhesive tape 6B is formed into a tubular shape covering a circumference of the crimping region 4, by winding, for example, the adhesive tape 6B having a lateral length (or a longitudinal length) larger than a length of the crimping region 4, around the crimp terminal 2, within the range containing the crimping region 4.

The end face and the outer face of the distal end 12*a* of the core wire part 12 to be crimped on the crimp terminal 2 have been already covered with the adhesive tape 6A in the core wire end covering step. Therefore, when the crimping part tape covering step has been finished, a waterproofing structure in which an entire area of the crimping region 4 is tight-sealed with the adhesive tape 6A and the adhesive tape 6B is realized.

In case of this embodiment, in the core wire end covering step as shown in FIGS. 6A to 7B and the crimping part tape covering step as shown in FIG. 9, the aforesaid adhesive tapes 6A and 6B are pressed against the mating faces under such heating condition that the adhesive tapes 6A, 6B can exert appropriate ductibility, thereby to be brought into tight contact with the mating faces.

In the method of waterproofing the crimping part in the second embodiment which has been heretofore described, by conducting the core wire end covering step as shown in FIGS. 6A to 7B, the wire crimping step as shown in FIGS. 8A to 8C, and the crimping part tape covering step as shown in FIG. 9, the waterproofing structure formed of the adhesive tapes 6A and 6B in which the crimping part is tight-sealed and the swell outward of the crimping part is depressed to 0.1 mm or less can be obtained.

Therefore, it is possible to enhance erosion resistance of the crimping part, without damaging fitting ability to the connector housing, in the same manner as in the first embodiment.

Moreover, in this second embodiment, the adhesive tapes 6A and 6B are pressed against the mating faces in a state where the adhesive tapes 6A and 6B have been made easily extendable by heating, in the core wire end covering step and the crimping part tape covering step, and tight-sealed to the mating faces. Therefore, the adhesive tapes 6A and 6B extend according to undulations of the outer face of the core wire part 12 to be crimped and undulations of the outer face of the crimp terminal 2, so that the adhesive tapes 6A and 6B can be firmly attached to the mating faces, and the sealing performance with the adhesive tapes 6A and 6B can be further enhanced.

Moreover, in this second embodiment too, because the transparent adhesive tapes 6A and 6B are used, condition of the crimping part can be visually seen through the adhesive tapes 6A and 6B. As the results, occurrence of rust on the crimping part can be visually detected at an early time, without removing the adhesive tapes 6A and 6B, and it is possible to cope with the case where the rust has occurred in the crimping part, at an early time.

It is to be noted that the method of covering the end face and the outer face of the distal end 12*a* of the core wire part 12 to be crimped with the adhesive tape 6A, in the core wire end covering step in this second embodiment, is not limited to the method as shown in the above described embodiment.

Figure 10A:
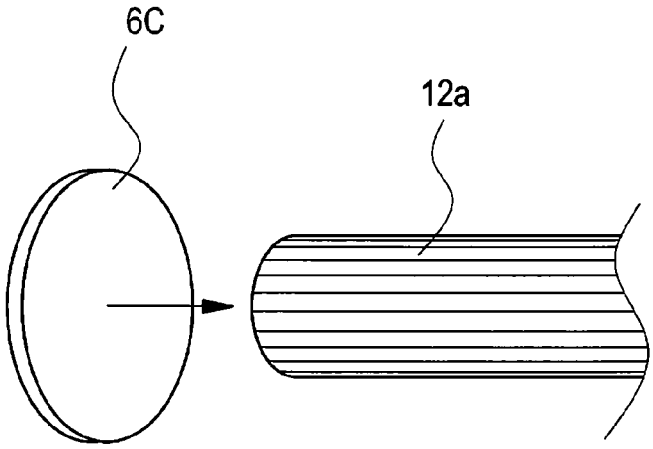
FIG. 10A is a perspective view showing an example where a tape in a round shape is used, in the second embodiment.

For example, as shown in FIG. 10A, an adhesive tape 6C in a round shape having a larger diameter than an outer diameter of the core wire part 12 to be crimped may be attached to the distal end face of the core wire part 12 to be crimped. Thereafter, a peripheral edge part of the adhesive tape 6C may be covered around the distal end 12*a*. Further, a part of the adhesive tape 6C which is covered around the distal end 12*a* may be squeezed so that the end face and the outer face of the distal end 12*a* of the core wire part 12 to be crimped can be tight-sealed with the adhesive tape 6C.

Figure 10B:
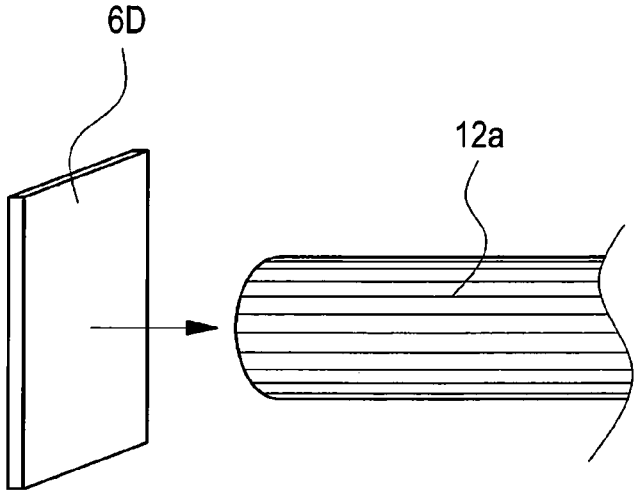
FIG. 10B is a perspective view showing an example where a tape in a strip shape is used, in the second embodiment.

Moreover, as shown in FIG. 10B, an adhesive tape 6D in a strip shape having a width larger than the outer diameter of the core wire part 12 to be crimped may be covered over the distal end 12*a* of the core wire part 12 to be crimped in a U-shaped manner, so that the end face and the outer face of the distal end 12*a* of the core wire part 12 to be crimped can be tight-sealed with the adhesive tape 6D.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

The disclosures of Japanese Patent Application No. 2009-219559 filed Sep. 24, 2009 including specification, drawings and claims is incorporated herein by reference in its entirety.

What is claimed is:

1. A method of waterproofing a crimping part of a crimp terminal where a wire is crimped, the method comprising:

forming a waterproofing structure sealing a crimping region containing the crimping part with an adhesive tape, the adhesive tape having waterproofing performance and having a thickness no more than a predetermined value, wherein a material of the crimp terminal and a material of the core wire are different from each other, the material of the crimp terminal is copper family material, and the material of the core wire is aluminum, the forming includes:

covering a portion of the exposed core wire part and a circumferential face of a distal end portion of the core wire with a secondary adhesive tape, the distal end portion projecting on a neck part of the crimp terminal;

crimping the portion of the core wire to the crimp terminal after the covering, the exposed core wired part being covered with the secondary adhesive tape; and covering the crimping region including the secondary adhesive tape with the adhesive tape after the crimping.

2. The method of waterproofing the crimping part as set forth in claim 1, wherein the covering of the end face and the circumferential face is performed under heating condition so that the adhesive tape exerts ductibility.

3. The method of waterproofing the crimping part as set forth in claim 1, wherein the predetermined value is 0.05mm.

* * * * *